US005377884A

United States Patent [19]

Zuckerman

[11] Patent Number: 5,377,884

[45] Date of Patent: Jan. 3, 1995

[54] INDICATOR AND GARMENT HANGER

[75] Inventor: Andrew M. Zuckerman, Forest Hills, N.Y.

[73] Assignee: Different Dimensions Inc., Rego Park, N.Y.

[21] Appl. No.: 130,623

[22] Filed: Oct. 1, 1993

[51] Int. Cl.[6] ..... A47G 25/14

[52] U.S. Cl. ..... 223/85; 40/322

[58] Field of Search ..... 40/322; 223/85, 88, 223/92; D6/315

[56] References Cited

U.S. PATENT DOCUMENTS

| | | | |
|---|---|---|---|
| 3,024,953 | 3/1962 | O'Keefe | 40/322 |
| 3,949,914 | 4/1976 | Ostroll | 40/322 |
| 4,123,864 | 11/1978 | Batts et al. | 40/322 |
| 4,322,902 | 4/1982 | Lenthall | 40/322 |

*Primary Examiner*—Clifford D. Crowder
*Assistant Examiner*—Bibho Mohanty
*Attorney, Agent, or Firm*—Amster, Rothstein & Ebenstein

[57] ABSTRACT

In combination, a hanger for garments and other articles and a separately formed indicator secured to the hanger for indicating information associated with the garments and other articles and manually releasable therefrom without the use of a tool. The hanger defines a hook adapted to engage a rail, and the hook in turn defines a support for receiving and engaging the indicator. The indicator is received and engaged by the support. The indicator includes a hollow four-sided body defining an open top, an open bottom, a generally parallel pair of opposed sides, and a generally parallel pair of opposed ends connecting the sides, each side having a generally planar side surface and each end having a generally planar end surface extending beyond both of the planar side surfaces. The indicator is disengageable and removable from the support by manually moving at least one of the ends towards the other end, thereby to cause the sides to bow outwardly relative to the support.

18 Claims, 3 Drawing Sheets

FIG. 6
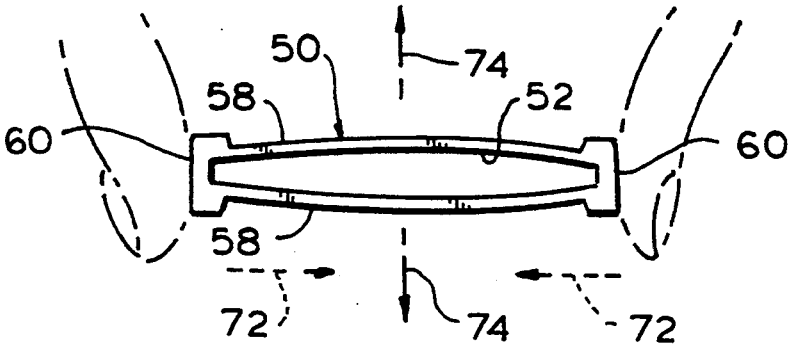
FIG. 5
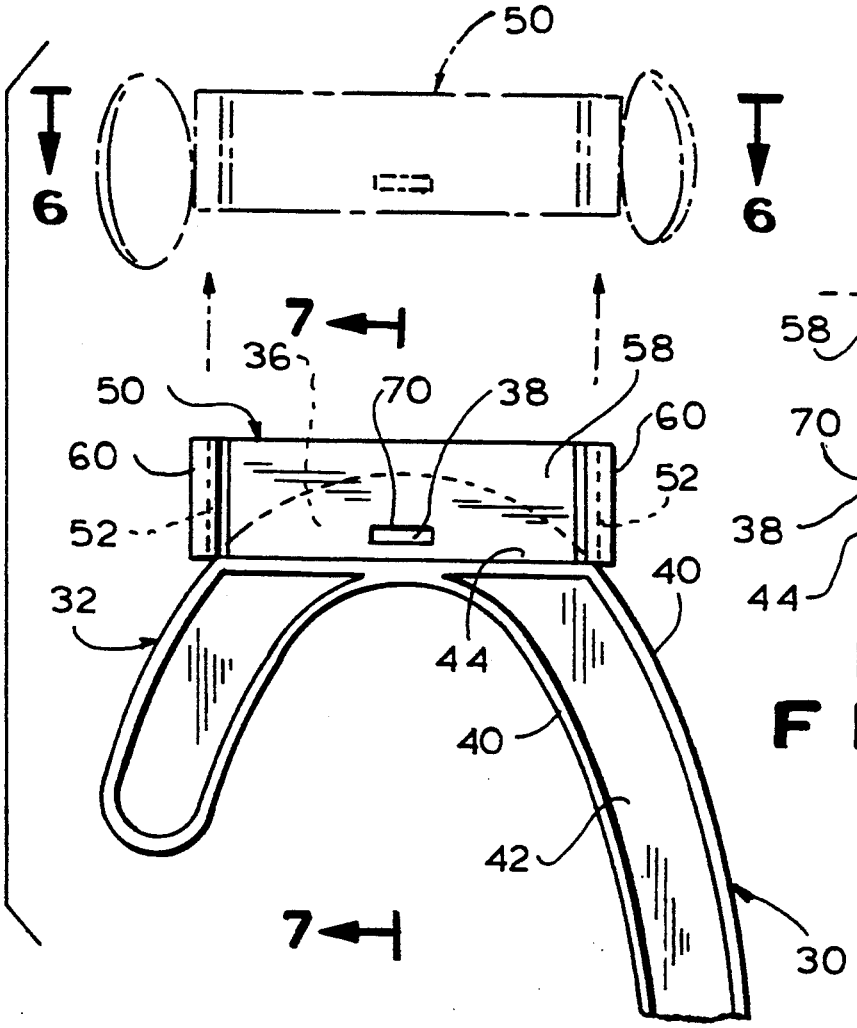
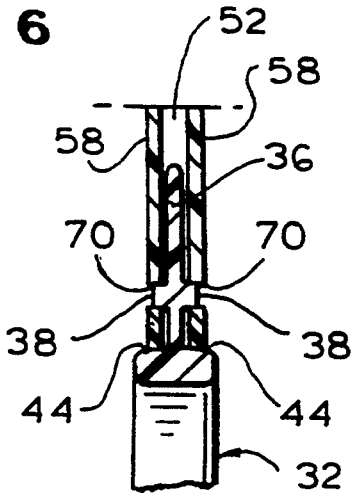
FIG. 7

INDICATOR AND GARMENT HANGER

BACKGROUND OF THE INVENTION

The present invention relates to hangers for garments and other articles in combination with a separately formed indicator secured to a hanger for indicating information associated with the articles.

When garments and other articles are displayed in retail stores on hangers, it is essential that the customer be able to determine with ease information associated with the garments and other articles, such as the size, manufacturer, price and the like. It is known to provide hangers with tabs or other indicators which either rest on the shoulder of the hanger or in the crook between the shoulder of the hanger and the lower portion of the hook used to support the hanger on a rail, rack or like supporting element. These tabs or indicators are not entirely satisfactory in use because the garment-carrying hangers are typically disposed closely adjacent one another on the rail in a side-to-side relationship such that the tabs may be at least partially concealed by clothing carried on the adjacent hangers. Thus, the information may not be easily viewable until the hanger is removed from the rail.

Accordingly, U.S. Pat. No. 4,322,902 discloses an indicator which is disposed on the top of the hook of the hanger for ready visibility. The indicator is a hollow four-sided body defining an open top, an open bottom, a generally parallel pair of opposed sides, and a pair of opposed ends connecting the sides but not extending outwardly therebeyond. The sides define inwardly extending beads which are engaged by outwardly extending flanges at the top of the hook to preclude accidental dislodgment of the indicator from the hanger. However, the sides extend above the top of the hook so that a tool may be inserted between the sides (adjacent the tops thereof) to force them apart until the beads no longer engage the flanges. The indicator may then be slid upwardly off the hook. Thus, non-destructive removal of the indicator from the hanger placed on the hanger—e.g., because a different size garment has now been placed on the hanger—is difficult and requires the use of a tool.

FIGS. 1 and 2 show a commercial indicator 10 which is also adapted to fit on the top of the hook of a hanger. It has a hollow four-sided body 12 defining a closed top 14, an open bottom 16, a generally parallel pair of opposed sides 18, and a generally parallel pair of opposed ends 20 connecting the sides but not extending outwardly therebeyond. The indicator is very thin so that the information (typically in the form of engraved letters or numbers) may be disposed only on the sides thereof, and not on the ends thereof as the ends are too small and rounded for this purpose. Each side of the top of the hanger defines an outwardly extending boss which is received within a respective aperture 24 in each side of the indicator to lock the indicator on the hanger. As the top of the hook completely fills the open bottom of the indicator and the top of the indicator is closed, there is no simple non-destructive way to remove the indicator from the hanger. Even aside from its non-removability, this indicator has not proven to be entirely satisfactory in use as the sides of the indicator (which are the only portions of the indicator which bear information) are typically completely concealed by the sides of the indicators of adjacent hangers when it is grouped with other hangers on a rail. Thus, the information is not easily viewable until the hanger is removed from the rail. Further, the indicator must be formed by injection molding which is extremely expensive and limited to moldable materials.

Accordingly, it is an object of the present invention to provide an indicator-and-hanger combination wherein the indicator is easily and non-destructively disengageable and removable from the hanger manually, without the use of tools.

Another object is to provide such a combination wherein in a preferred embodiment the indicator is readily visible when the hanger is in view by virtue of its position on the hook.

A further object is to provide such a combination wherein in a preferred embodiment the information regarding the garments and other articles is disposed both on the side and end surfaces of the indicator for ready visibility, even when the hanger is on a rack with like hanger on either side thereof.

It is also an object of the present invention to provide such a combination which is inexpensive to manufacture and maintain and simple to use.

SUMMARY 0F THE INVENTION

It has now been found that the above and related objects of the present invention are obtained by, in combination, a hanger for garments and other articles and a separately formed indicator secured to the hanger for indicating information associated with the garments and other articles and manually releasable therefrom without the use of a tool. The hanger defines a hook adapted to engage a rail or other supporting means, the hook defining support means for receiving and engaging the indicator. The indicator is received and engaged by the support means. The indicator includes a hollow four-sided body defining an open bottom, a generally parallel pair of opposed sides, and a generally parallel pair of opposed ends connecting the sides. Each side has a generally planar side surface, and each end has a generally planar end surface extending beyond both of the planar side surfaces. The indicator is disengageable and removable from the support means by manually moving at least one of the ends towards the other end, thereby to cause the sides to bow outwardly relative to the support means.

In a preferred embodiment, the support means defines a boss projecting outwardly from each opposed side thereof, and the indicator defines on each of the sides thereof an aperture receiving the boss therein. Preferably the boss is disposed centrally along the length of each opposed side of the support means. The indicator body has an open top and strongly resilient sides, each side being configured and dimensioned to resiliently bow outwardly as the ends are moved towards one another. Typically each of the planar side surfaces and each of the planar end surfaces faces outwardly of the indicator and bears thereon information associated with the article, the information being printed on or molded onto the planar side and end surfaces.

Preferably the hook has the support means at the top thereof, and the indicator is readily visible when the hanger is in use by virtue of its position on the hook.

In a preferred embodiment, the indicator body defines a slot intermediate the top, bottom, sides and ends, the slot having a pair of generally parallel sides and a pair of acutely angled ends for facilitating outward bowing of the indicator sides relative to the support means as the indicator ends approach each other.

BRIEF DESCRIPTION OF THE DRAWING

The above and related objects, features, and advantages of the present invention will be more fully understood by reference to the following detailed description of the presently preferred, albeit illustrative, embodiments of the present invention when taken in conjunction with the accompanying drawing wherein:

FIG. 5 is a fragmentary side elevational view of a combination of an indicator and hanger according to the present invention, the indicator in the process of being removed from the hanger being shown in phantom line;

FIG. 6 is a top plan view taken along the line 6—6 of FIG. 5;

FIG. 7 is a fragmentary sectional view taken along the line 7—7 of FIG. 5.

DETAILED DESCRIPTION OF THE PREFERRED EMBODIMENTS

Figure 1:
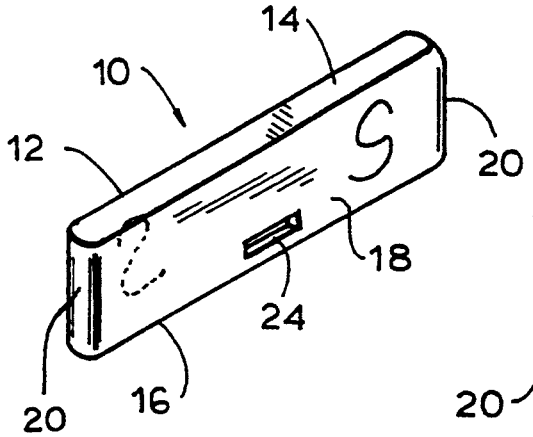
FIG. 1 PRIOR ART
FIGS. 1 and 2 are isometric views of a prior art indicator.
Figure 2:
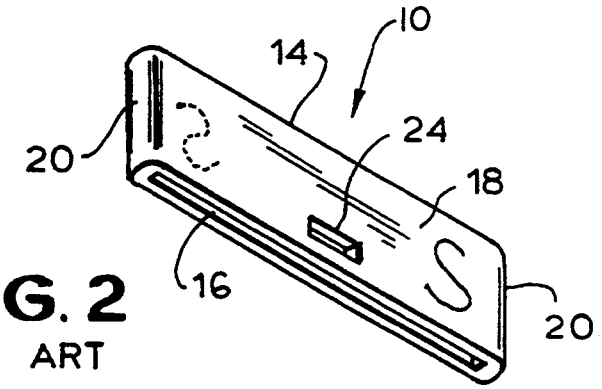
FIG. 2 PRIOR ART

Referring now to the drawing, and in particular to FIGS. 5 and 7 thereof, therein illustrated is a hanger for garments and other articles generally designated by the reference numeral 30. The hanger 30 defines a hook generally designated 32 and adapted to engage a rail, rack or like supporting element (not shown), and a conventional body adapted to support the garments or other articles on the hanger 30. The hook 32 in turn defines support means 36 for receiving and engaging an indicator according to the present invention. A boss 38 projects outwardly from each side of the support means 36, each boss 38 preferably being disposed centrally along the length of each side of the support means 36.

The support means 36 is typically thinner than the remainder of the hook 32. Where the hanger is formed with thickened marginal portions 40 connected by thin webs 42 (to provide strength while still conserving on the amount of plastic material used), the support means 36 may simply be a portion of the hook 32 devoid of a thickened upper marginal portion so that it has the thickness of the web 42 (except for the bosses 38 extending therefrom). Preferably the hook 32 defines the support means 36 at the top thereof and includes a thickened portion or outwardly projecting ledge 44 immediately below and on each side of the support means 36 for connecting the thickened marginal portions 40 disposed on either side of the support means 36 and limiting downward movement of the support means 36.

The hanger 30 may be-formed of any of the conventional materials used for garment hangers, typically a moldable material such as polystyrene. The thickness of the hanger, and especially the thickened marginal portions 40, will vary with the intended use of the hanger—e.g., the weight of the garments or other articles to be supported thereby. It will be appreciated that while the hanger is referred to herein as a garment hanger, the principles of the present invention apply equally to hangers for other articles where information regarding the other articles is to be communicated to the potential customer.

Additionally, while the hook 32 has been illustrated as having a constant web width or separation between the thickened marginal portions 40, so that there is no enlargement of the head of the hook 32, the principles of the present invention apply equally to hangers wherein the hook 32 has an enlarged or wider head portion so that the top of the support means 36 extends higher than is shown (i.e., above the top contour of the hook) because of the greater width of the hook 32 in the region of the support means 36.

Figure 3:
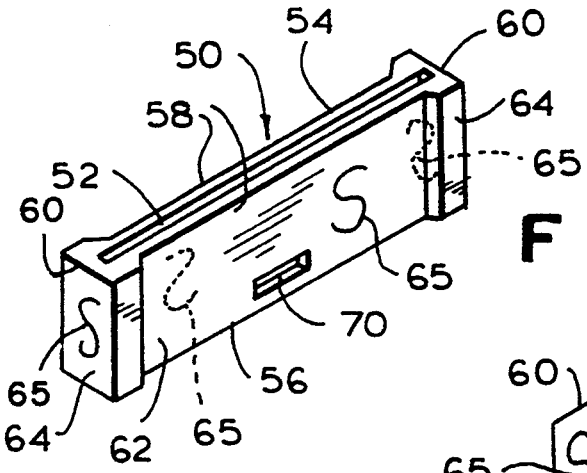
FIGS. 3 and 4 are isometric views of an indicator according to the present invention.
Figure 4:
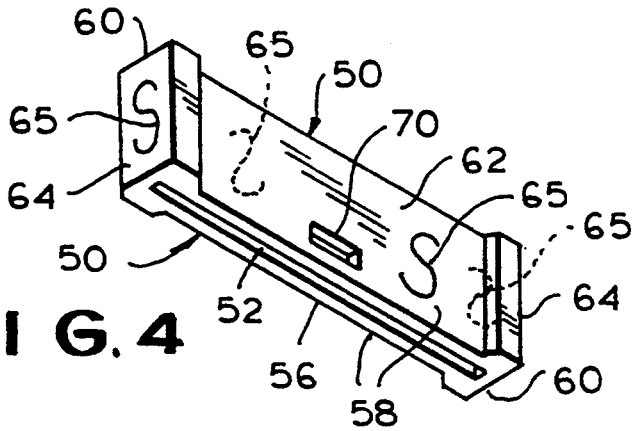

Referring now to FIGS. 3 and 4 in particular, therein illustrated is an indicator according to the present invention, generally designated 50. The indicator 50 is configured and dimensioned to be received and engaged by the hanger support means 36. Assuming the support means 36 is at the top of the hook 32, the indicator 50 is readily visible when the hanger 10 is in use by virtue of its position on the hook 32. More particularly, the indicator 50 includes a hollow four-sided body 52 defining an open top 54, an open bottom 56, a generally parallel pair of opposed sides 58 connecting the top and bottom 54, 56, and a generally parallel pair of opposed ends 60 connecting the sides 58 and typically also connecting the top and bottom 54, 56. Each side 58 has an outwardly facing, generally planar side surface 62, and each end 60 has an outwardly facing, generally planar end surface 64. In the preferred embodiment of the invention illustrated, the planar end surfaces 64 extend outwardly beyond both of the planar side surfaces 62 so as to provide an ample area on which information 65 (e.g., "S" for small) may be molded or printed. The information 65 is preferably molded or printed onto both planar side and end surfaces 62, 64 so that the information is readily viewable from all sides of the indicator 50. Thus, even when the indicator-bearing hanger 30 is sandwiched on a rail between two other indicator-bearing hangers, the information 65 remains readily viewable from either end of the indicator 50 without removal of the hanger from the rail.

Referring now also to FIGS. 5–7, in order to prevent accidental disengagement of the indicator 50 from the hanger 30, the indicator is provided with an aperture 70 on each side 58 thereof, each aperture 70 being configured and dimensioned to receive therein its respective boss 38 of the support means 36 of the hanger hook 32 when the open bottom 56 of the indicator abuts the outwardly projecting, thickened portion or ledge 44 below the support means 36. Clearly, more than one boss 38 may be provided on each side of the support means 36, with a corresponding number of apertures 70 being provided on each side 58 of the indicator.

It will be appreciated that the engagement mechanism utilized in the preferred embodiment may be varied without departing from the principles of the present invention. Thus the inwardly facing surfaces of the indicator sides 58 may define inwardly projecting bosses and the hanger support means 36 may define apertures therethrough for receipt of the bosses. In this instance, the squeezing together of the indicator ends would cause the indicator bosses to retreat from the support means apertures, thereby to permit removal of the indicator from the hanger.

The configuration and dimensions of the indicator, as well as the plastic from which the indicator is made, are selected to render the indicator disengageable and removable from the support means 36 by manually moving at least one of the indicator ends 60 towards the other indicator end 60, thereby to cause indicator sides 58 to bow outwardly relative to the support means 36. As the indicator sides 58 bow outwardly, the apertures 70 through the indicator sides 58 will clear the bosses 38 on the support means 36, thereby allowing the indicator 50 to be easily slid upwardly and off of the supporting means 36, thereby separating the indicator 50 and the hanger 30. Generally this movement of the one indicator end 60 towards the other will be accomplished by fingers (illustrated in FIGS. 5 and 6) squeezing the two opposed indicator ends 60 towards one another with a conventional squeezing action. The degree of bowing been exaggerated in FIG. 6 for expository purposes.

The indicator sides 58 are preferably strongly resilient (i.e., elastic) so that, when pressure on one of the indicator ends 60 is released, the indicator 50 will resume its original configuration. However, the indicator sides 58 are not so strongly resilient (i.e., resistant to flexing) that they will not automatically flex or bow outwardly when the indicator 50 is being inserted downwardly onto the support means 36, thereafter resuming their original configuration as the support means bosses 38 slide into the indicator apertures 70. For example, the upper surface of each boss 38 may be bevelled downwardly and outwardly to facilitate camming of the indicator sides over the bosses during the indicator application process. If desired, the indicator sides 58 may be made sufficiently strongly resilient that children are unable to squeeze the indicator ends 60 together with the force required to cause the indicator sides 58 to flex and bow outwardly enough for indicator apertures 70 to clear the support means bosses 38, while an adult would be easily capable of mustering such force.

It will be appreciated that the enlargement of the indicator ends 60 provides an area on the planar end surfaces 64 which is suitable for two functions—namely, for containing information and for facilitating squeezing of the indicator ends together for removal of the indicator from the hanger.

Because the planar end surfaces 64 are large enough and flat enough to be conveniently grasped between the fingers, they permit flexing of the indicator sides 58 and removal of the indicator from the hanger without the use of tools. However, as the top 54 of the indicator 50 is open and is typically not completely occupied by the support means 36, if desired, a tool such as a screwdriver blade may be inserted through an unoccupied area of the open top 54 and between the indicator sides 58 and then rotated to cause the indicator sides 58 to bow outwardly and disengage from the hook bosses 38. The use of a tool is discouraged, however, as the tool may damage the indicator and/or hanger and thereby impair re-usability of the indicator and/or hanger. By way of contrast, removal of the indicator from the hanger without the use of tools—that is, simply by squeezing the ends of the indicator together—does not damage either the indicator or the hanger and permits both of them to be reused.

The present invention has been described above as having a boss 38 projecting outwardly from each opposed side of the support means 36 and an indicator 50 defining an aperture 70 on each of the sides 58 thereof for receiving a boss 38 therein. However, depending upon the ease or difficulty with which the indicator 50 is to be removable from the hanger 10, the sizes of the bosses 38, the stiffness of the indicator sides 58, etc., the support means 36 may define a boss 38 projecting outwardly from only one of the opposed sides thereof and the indicator may define on only one of the sides 58 thereof an aperture 70 for receiving the boss 38 therein.

As the indicators 50 of the present invention are open at both the top and bottom 54, 56, they may be inexpensively made, e.g., of polyvinyl chloride, by extrusion at a fraction of the cost required by the conventional indicators which must be injection molded due to the presence of a closed top. Of course, the indicator 50 could also be injection molded, e.g., of polystyrene.

While the indicator ends 60 have been described as generally parallel and having outwardly facing, generally planar end surfaces 64, a limited degree of variation in the parallel nature of the ends and the planarity of the end surfaces is possible in order to achieve desired goals. For example, the planar end surfaces 64 may be slightly concave to more readily accept finger pressure thereon. The degree of concavity should not interfere, however, with the printing or molding of information on the indicator end surfaces 64. Similarly, the indicator ends 58 may be disposed at a slight angle to one another in order to make squeezing of the ends together either easier or harder, provided again that the tilting does not interfere with the printing or molding of information on the planar end surfaces 64.

Referring now to FIG. 5, therein illustrated is a hanger-and-indicator combination according to the present invention wherein the indicator ends 60 are being squeezed together (in the direction of arrows 72) in order to cause an outward bowing of the indicator sides 58 (in the direction of arrows 74), thereby to disengage the support means bosses 38 and indicator apertures 70 and permit withdrawal of the indicator 50 from the hanger 10 (in the direction of arrows 76). A slight spacing is preferably provided intermediate the inner surface of each indicator end 60 and the adjacent end of the support means 36, at least at the level of bosses 38 and apertures 70, in order to enable the indicator ends 60 to approach each other sufficiently for apertures 70 to clear the bosses 38 when the indicator ends are squeezed together.

Figure 8:
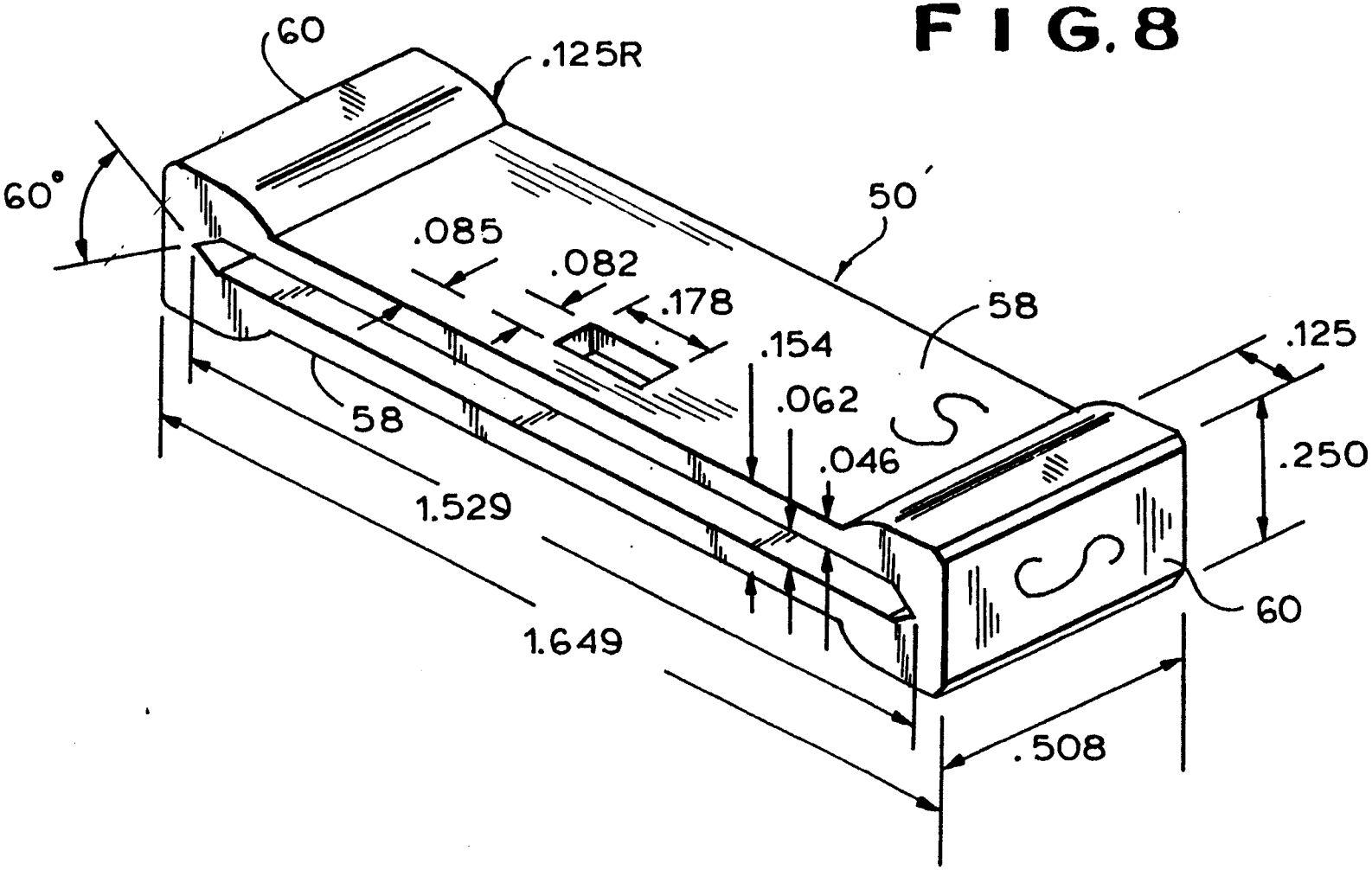
FIG. 8 is an isometric view of another embodiment of the indicator of the present invention.

Referring now to FIG. 8, therein illustrated is another preferred embodiment of the indicator of the present invention, generally designated 50'. The dimensions indicated thereon (in inches and degrees) are representative of a preferred embodiment used in connection with a garment hanger. The dimensions may vary substantially depending upon the intended application of the indicator, operable dimensions being easily determinable by routine experimentation using the dimensions of the preferred embodiment as a starting point. The indicator 50' of FIG. 8 varies from the indicator 30 of FIGS. 3–7 both functionally and cosmetically.

The large slot defined by the indicator 50' (and in particular, the sides and ends of the body thereof) define adjacent each end an angle, preferably a 60° angle, to facilitate squeezing together of the indicator ends 60 and the resultant outward bowing of the indicator sides 58. Thus in embodiment 50' the support means 36 may fill the indicator slot up to the points where the slot sides begins to angle inwardly in order to form the end angles. Of course, angles other than 60° may be employed depending upon the desired ease or difficulty of indicator removal, the resistance of the indicator sides to outward bowing, etc. The cosmetic changes in embodiment 30' primarily involve rounding off and beveling of the outer surfaces of the indicator ends 60.

To summarize, the present invention provides an indicator-and-hanger combination wherein the indicator is easily and non-destructively disengageable and removable from the hanger manually, without the use of tools. In a preferred embodiment the indicator is readily visible when the hanger is in view by virtue of its position on the hook, and the information regarding the articles is disposed both on the side and end surfaces of the indicator for ready visibility, even when the hanger is on a rack with like hangers on either side thereof. The combination is inexpensive to manufacture and maintain and simple to use.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. In combination, a hanger for garments and other articles and a separately formed indicator secured to said hanger for indicating information associated with the; articles said hanger defining a hook adapted to engage a rail or other supporting means, said hook defining support means for receiving and engaging said indicator; and said indicator being received and engaged by said support means, said indicator including a hollow four-sided body defining an open bottom, an open top, a generally parallel pair of opposed sides and a generally parallel pair of opposed ends connecting said sides, each said side having a generally planar outer side surface and each said end having a generally planar outer end surface extending beyond both of said planar outer side surfaces.

2. The combination of claim 1 wherein said support means defines a boss projecting outwardly from at least one opposed side thereof, and said indicator defines on at least one of said sides thereof an aperture receiving said boss therein.

3. The combination of claim 2 wherein said support means defines a boss projecting outwardly from each opposed side thereof, and said indicator defines on each of said sides thereof an aperture receiving said boss therein.

4. The combination of claim 3 wherein said boss is disposed centrally along the length of each opposed side of said support means.

5. The combination of claim 1 wherein said sides are strongly resilient.

6. The combination of claim 1 wherein each of said sides is configured and dimensioned to resiliently bow outwardly as said ends are moved towards one another.

7. The combination of claim 1 wherein each of said planar side surfaces and each of said planar end surfaces faces outwardly of said indicator and bears thereon information associated with the articles.

8. The combination of claim 7 wherein said information is molded onto said planar side and end surfaces.

9. The combination of claim 7 wherein said information is printed onto said planar side and end surfaces.

10. The combination of claim 1 wherein said hook has said support means at the top thereof, and said indicator is readily visible when said hanger is in use by virtue of its position on said hook.

11. The combination of claim 1 wherein said hanger support means defines an outwardly projecting, thickened portion abutting said indicator open bottom.

12. The combination of claim 1 wherein said indicator body defines a slot intermediate said top, bottom, sides and ends, said slot having a pair of generally parallel sides and a pair of acutely angled ends for facilitating outward bowing of said indicator sides relative to said support means as said indicator ends approach each other.

13. In combination, a hanger for garments and other articles and a separately formed indicator secured to said hanger for indicating information associated with the articles and manually releasable therefrom without the use of a tool;

said hanger defining a hook adapted to engage a rail or other supporting means, said hook defining support means for receiving and engaging said indicator; and said indicator being received and engaged by said support means, said indicator including a hollow four-sided body defining an open top, an open bottom, a generally parallel pair of opposed sides, and a generally parallel pair of opposed ends connecting said sides, each of said sides being strongly resilient and configured and dimensioned to resiliently bow outwardly as said ends are moved towards one another, each said side having an outwardly facing, generally planar side surface and each said end having an outwardly facing, generally planar end surface extending beyond both of said planar side surfaces, each of said planar side surfaces and each of said planar end surfaces bearing thereon information associated with the garment, said indicator being disengageable and removable from said support means by manually moving at least one of said ends towards the other end, thereby to cause said sides to bow outwardly relative to said support means.

14. The combination of claim 13 wherein said support means defines a boss projecting outwardly from a side thereof and disposed centrally along the length of the side thereof, and said indicator defines on one of said sides thereof an aperture receiving said boss therein.

15. The combination of claim 13 wherein said indicator body defines a slot intermediate said top, bottom, sides and ends, said slot having a pair of generally parallel sides and a pair of acutely angled ends for facilitating outward bowing of said sides relative to said support means as said indicator ends approach each other.

16. In combination, a hanger for garments and other articles and a separately formed indicator secured to said hanger for indicating information associated with the articles and manually releasable therefrom without the use of a tool;

said hanger defining a hook adapted to engage a rail or other supporting means, said hook defining support means for receiving and engaging said indicator; and said indicator being received and engaged by said support means, said indicator including a hollow four-sided body defining an open bottom, a top, a generally parallel pair of opposed sides and a generally parallel pair of opposed ends connecting said sides, each said side having a generally planar outer side surface and each said end having a generally planar outer end surface, said indicator body defining a slot intermediate said top, bottom, sides and ends, said slot having a pair of generally parallel sides and a pair of acutely angled ends for facilitating outward bowing of said indicator sides relative to said support means as said indicator ends approach each other such that said indicator is disengageable and removable from said support means by manually moving at least one of said ends towards the other end, thereby to cause said sides to bow outwardly relative to said support means.

17. In combination, a hanger for garments and other articles and a separately formed indicator secured to said hanger for indicating information associated with the articles and manually releasable therefrom without the use of a tool;

said hanger defining a hook adapted to engage a rail or other supporting means, said hook defining support means for receiving and engaging said indicator; and said indicator being received and engaged by said support means, said indicator including a hollow four-sided body defining an open bottom, a generally parallel pair of opposed sides and a generally parallel pair of opposed ends connecting said sides, each said side having a generally planar outer side surface and each said end having a generally planar outer end surface, each of said sides being configured and dimensioned to resiliently bow outwardly as said ends are moved towards one another such that said indicator is disengageable and removable from said support means by manually moving at least one of said ends towards the other end, thereby to cause said sides to bow outwardly relative to said support means.

18. The combination of claim 16 wherein said indicator body defines an open top.

* * * * *

UNITED STATES PATENT AND TRADEMARK OFFICE

CERTIFICATE OF CORRECTION

PATENT NO. : 5,377,884

DATED : January 3, 1995

INVENTOR(S) : Andrew M. Zuckerman

It is certified that error appears in the above-identified patent and that said Letters Patent is hereby corrected as shown below:

Column 9, lines 13-14, delete "and manually releasable therefrom without the use of a tool";

Column 10, line 3, after the comma, add --an open top,--;

line 10, delete "as said ends are moved towards one another";

line 11, after "is" add --engageable with or--;

line 11, delete "and removable";

lines 12-14, delete "manually moving at least one of said ends towards the other end, thereby to cause" and add --causing--.

Signed and Sealed this

Twenty-first Day of March, 1995

*Attest:*

Bruce Lehman

BRUCE LEHMAN

*Attesting Officer*

*Commissioner of Patents and Trademarks*